United States Patent [19]

Fortin

[11] 3,950,970

[45] Apr. 20, 1976

[54] PRE-SHIPMENT PROTECTIVE DEVICE

[76] Inventor: William O. Fortin, 71 Montello St., Lewiston, Maine 04240

[22] Filed: Aug. 20, 1974

[21] Appl. No.: 498,931

[52] U.S. Cl. ..... 70/63; 70/81; 70/144; 70/211; 70/337; 70/DIG. 63

[51] Int. Cl.[2] ..... E05B 65/52; E05B 63/14; E05B 35/08

[58] Field of Search ..... 70/156, 209, 211, 337, 70/DIG. 58, DIG. 60, 63, 81, 144

[56] References Cited

UNITED STATES PATENTS 3,768,284 10/1973 Kent et al. ..... 70/104

3,826,117 7/1974 Racobs ..... 70/416

FOREIGN PATENTS OR APPLICATIONS 783,438 9/1957 United Kingdom ..... 70/161

*Primary Examiner*—Albert G. Craig, Jr.

[57] ABSTRACT

A pre-shipment protective device is used on a teller's locker to protect monies to be transferred. Only the transfer agent has a key to open the pre-shipment protective device. Only the bank has a key to release the latch to again close the locker once the transfer agent has opened the pre-shipment protective device.

8 Claims, 8 Drawing Figures

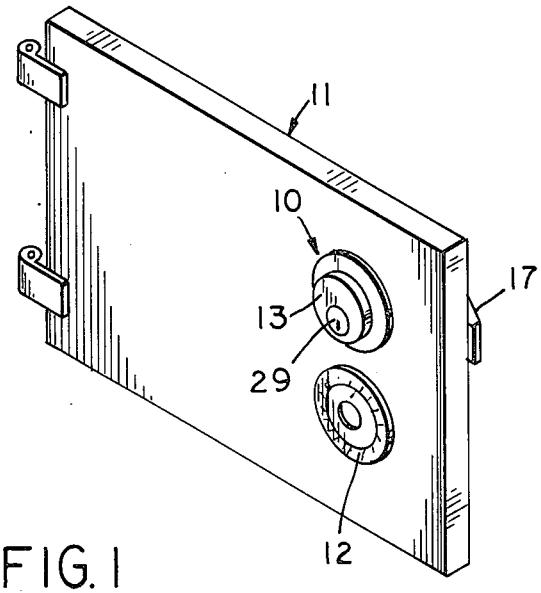
FIG. 1
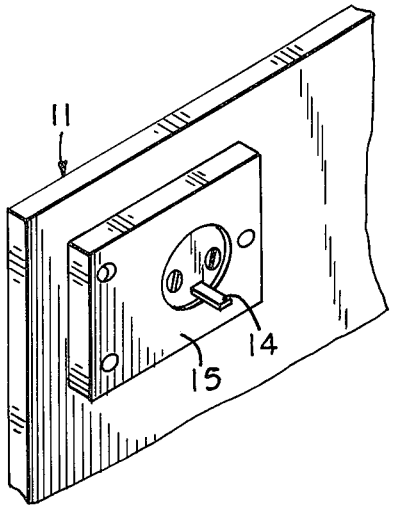
FIG. 3
FIG. 2
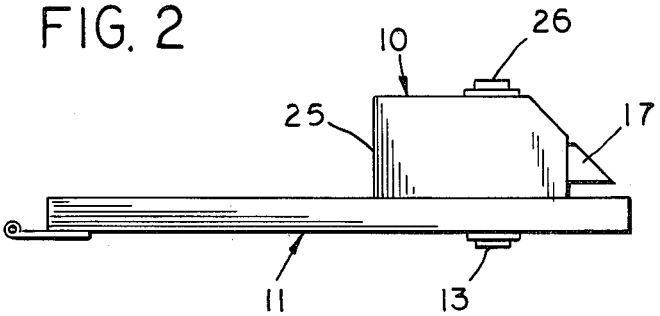
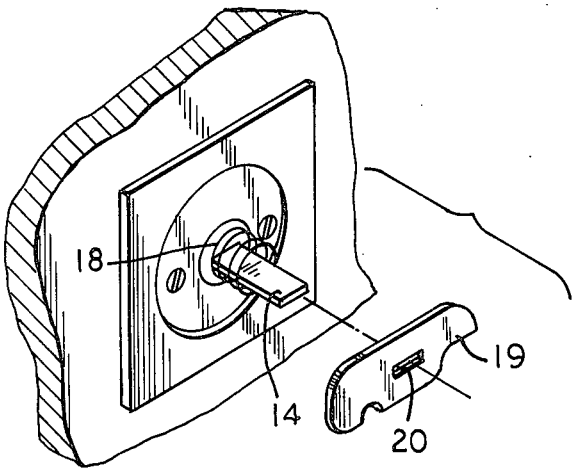
FIG. 4

PRE-SHIPMENT PROTECTIVE DEVICE

The present invention relates a pre-shipment protective device or locking system employable with a bank teller's locker.

The conventional teller's locker has its own lock usually openable as a combination lock by use of a dial. This locker can be used to store tellers' trays overnight, for instance.

When banks have excess funds, they are usually prepared in advance and are ready to be picked up. These transfer funds are usually not too well secured.

A fund to be transferred may be made up and placed in the teller's locker, having a pre-shipment protective device.

According to the present invention, a teller's locker has in addition to its normal locking means, a pre-shipment protective device comprising a first lock, usually a cylinder lock, a night latch with a latch bolt and an inside lock which may only unlock the night latch bolt.

Thus, in a transfer of funds, better security may be obtained by having the transfer agent only have a key to the cylinder lock. Thus, when the transfer agent arrives he may open the cylinder lock which remains in open position until released by the key, in possession of the bank, to the inside lock which can again release the night latch bolt.

The conventional locking means to the teller's locker can easily be employed with this pre-shipment protective device system.

Although such novel feature or features believed to be characteristic of the invention are pointed out in the claims, the invention and the manner in which it may be carried out, may be further understood by reference to the description following and the accompanying drawings.

FIG. 1 is a perspective elevation of a teller's locker door including a pre-shipment protective device of the present invention.

FIG. 2 is a plan view of a door showing a configuration of a pre-shipment device of the present invention.

FIG. 3 is a partial perspective of the inside of a locker door showing the mounting for the night latch.

FIG. 4 is an exploded detail of a cylinder lock, tail piece and a special stop mechanism.

Referring now to the figures in greater detail, where like reference numbers denote like parts in the various figures.

Figure 5:
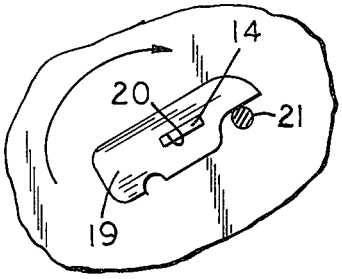
FIG. 5 is a cut-away view of a night latch showing the stop of FIG. 4 stopped by a stop in the night latch.

The pre-shipment protective device 10 as shown in FIG. 1 is an adjunct system on the door 11 of a teller's locker (not shown). The door usually includes a dial 12 for a combination lock (not shown) that can be used for the normal functioning of the teller's locker.

The pre-shipment protective device 10 preferably includes a rim cylinder 13 with a tail piece 14 extending through the door 11 and a mounting block 15 for mounting a night latch 16 having a spring-loaded bolt 17. The night latch 16 has a hold back feature.

In FIG. 4, mounted tail piece 14 coming through the mounting plate is shown with a low tension spring 18 and a special night latch stop 19. In FIG. 5, the tail piece 14 is shown engaged in the opening 20 and rotated in the direction of the arrow and stopped against the stop pin 21.

The activating knob 22 is provided with an angle iron 23 which may be affixed by screws 24.

When the latch bolt 17 is retracted, the angle iron 23 is held on the knob 22 in position to be activated as hereinafter to be shown. The stop 19 and stop pin 21 deter further movement of the tail piece 14.

As can be seen in FIG. 2, a latch cover 25 is provided with the latch bolt 17 extendable therethrough. Supported in the latch cover 25 is the banker's lock 26 having a cam 27.

Figure 8:
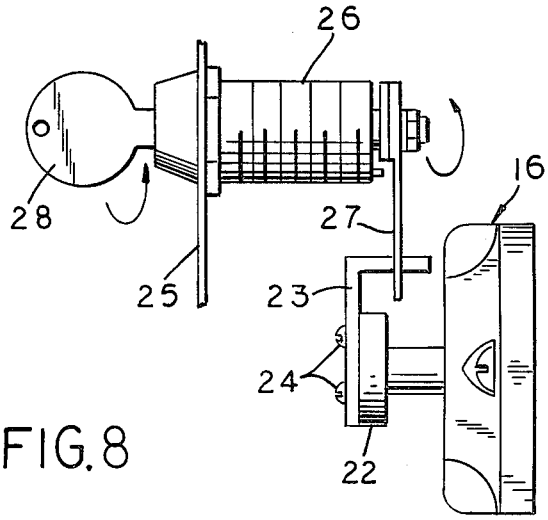
FIG. 8 is a partial side elevation of the night latch and bank lock disengaging the latch bolt.

As can be seen in FIG. 8, the cam 27, when the key 28 is rotated in the direction of the arrow, moves past the angle iron 23, releasing the bolt 17 as shown in FIG. 2.

Figure 7:
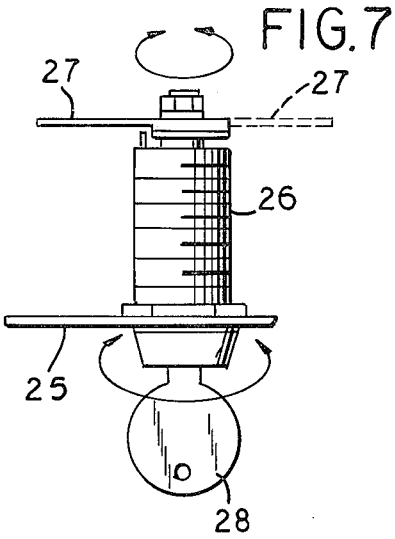
FIG. 7 is a plan view of the bank lock in the latch cover.
Figure 6:
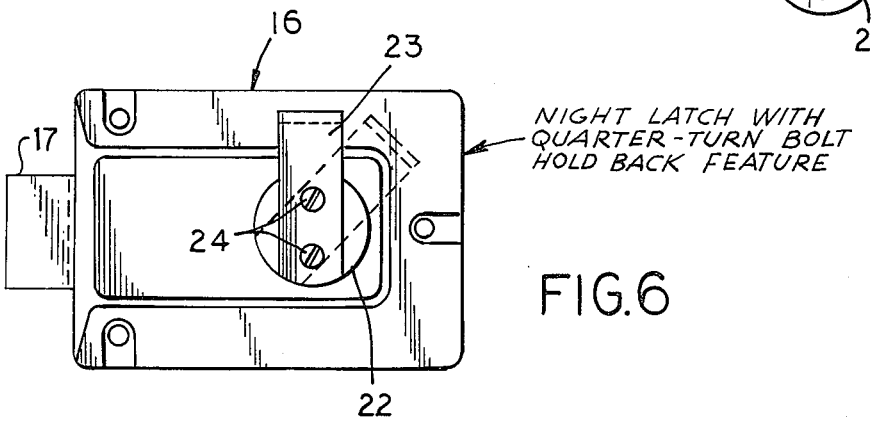
FIG. 6 is a front elevation of the night latch showing the bolt retracted with the stop as shown in FIG. 5.

In use, the bank should only have a key to the bank lock 26. The key to the bank lock 26 may only be removed when the cam 27 is in the position shown by the dotted lines in FIG. 7. Thus, when the key 28 is inserted into the banker's lock 26, as it is turned, the cam must pass the angle iron 23, releasing it from its stopped position and extending the bolt 17.

With the bolt 17 extended, the door 11, once closed, cannot be opened until the transfer agent with his key (not shown) to the rim cylinder 13, puts his key in the cylinder 29 and turns the tail piece 14 until it is stopped by the stop 19 on the stop pin 21 of the night latch 16. The transfer agent's key, preferably can only be removed by rotating it to the insert position in the cylinder 29. The bolt 17 remains retracted until the bank's key 28 is put into the banker's lock 26 to release the bolt 17 again.

With the latch bolt 17 retracted the teller's locker may be used normally, opening and closing the door 11, using the dial 12 for the combination lock (not shown). Of course, the bank could use its combination lock when the pre-shipment protective device 10 is engaged and unlock that before the transfer agent unlocks the locker.

Thus, it takes one key 28 to lock the teller's locker and another key to release the bolt 17. The party locking cannot unlock; the party unlocking cannot relock.

The terms and expressions which are employed are used as terms of description; it is recognized, though, that various modifications are possible.

Having thus described certain forms in some detail, what is claimed is:

1. A locking means adapted to be mounted on a receptacle in such a manner as to releasably hold the closure thereof in closed position, said locking means including;

A. latching means mountable on the inner side of a receptacle wall (including the closure), said latching means including a latch bolt, an inside actuating knob for said latch bolt, and means to releasably hold back said latch bolt when retracted, B. an exterior lock interconnected with said latch bolt in such a manner that it will function only to retract said latch bolt and including a key opening, said exterior lock being mountable on the receptacle wall with said key opening accessible from the outer side thereof, said exterior lock further including a stop means cooperating with a key controlled portion of this lock to limit retraction of said latch bolt to a position wherein it is held by said hold back means, and C. an interior lock including a housing mountable over and, in combination with the receptacle wall, enclosing said latching means and having an opening in a wall thereof through which said latch bolt operates, said interior lock further including cam means within said housing and associated with said inside actuating knob in such a manner that it will function only to release said latch bolt from said hold back means, and additionally including key controlled means carried by said housing and interconnected with said cam means for controlling movement thereof, this key controlled means including a key opening accessible from the exterior of said housing.

2. The invention of claim 1 wherein the exterior and interior locks require different keys.

3. The invention of claim 1 wherein at least the key of said exterior lock is removable therefrom only when positioned the same as it was when inserted.

4. The invention of claim 1 wherein the key of each of said locks is removable from its respective lock only when positioned the same as it was when inserted.

5. The invention of claim 1 wherein said first lock is a cylinder lock.

6. The invention of claim 5 wherein said cylinder lock includes a tail piece.

7. The invention of claim 6 wherein said tail piece actuates said latch bolt.

8. The invention of claim 1 wherein said stop means includes a stop pin.

* * * * *